US006213418B1

(12) United States Patent
Gabriel et al.

(10) Patent No.: US 6,213,418 B1
(45) Date of Patent: Apr. 10, 2001

(54) VARIABLE THROW ECCENTRIC CONE CRUSHER AND METHOD FOR OPERATING THE SAME

(75) Inventors: Michael R. Gabriel, Toulouse-Cedex (FR); Ulhas S. Sawant, Hartland; David W. Ambrose, Mequon, both of WI (US)

(73) Assignee: Martin Marietta Materials, Inc., Raleigh, NC (US)

( * ) Notice: Subject to any disclaimer, the term of this patent is extended or adjusted under 35 U.S.C. 154(b) by 0 days.

(21) Appl. No.: 09/173,037

(22) Filed: Oct. 14, 1998

(51) Int. Cl.[7] ..... B02C 2/04
(52) U.S. Cl. ..... 241/207; 241/208; 241/210
(58) Field of Search ..... 241/27, 29, 37, 241/207, 208, 215, 210

(56) References Cited

U.S. PATENT DOCUMENTS

| | | | | |
|---|---|---|---|---|
| 2,168,582 | * | 8/1939 | Rider | 241/207 |
| 2,171,429 | * | 8/1939 | Kiesskalt | 241/207 |
| 2,409,391 | | 10/1946 | Rumpel | 241/208 |
| 2,509,920 | | 5/1950 | Gruender | 241/202 |
| 3,235,190 | | 2/1966 | Symons | 241/299 |
| 3,539,120 | | 11/1970 | Szaj | 241/299 |
| 3,542,301 | | 11/1970 | Trifonov et al. | 241/207 |
| 3,570,774 | | 3/1971 | Gasparac et al. | 241/207 |
| 3,604,640 | | 9/1971 | Webster | 241/215 |
| 3,690,573 | | 9/1972 | Kueneman et al. | 241/207 |
| 3,759,453 | | 9/1973 | Johnson | 241/207 |
| 3,797,759 | | 3/1974 | Davis et al. | 241/30 |
| 3,797,760 | | 3/1974 | Davis et al. | 241/30 |
| 3,804,342 | | 4/1974 | Gasparac et al. | 241/37 |
| 3,843,068 | | 10/1974 | Allen et al. | 241/285 R |
| 3,887,143 | | 6/1975 | Gilbert et al. | 241/215 |
| 3,966,130 | | 6/1976 | Doty | 241/285 R |
| 3,985,308 | | 10/1976 | Davis et al. | 241/290 |
| 4,168,036 | | 9/1979 | Werginz | 241/285 R |
| 4,198,003 | | 4/1980 | Polzin et al. | 241/30 |
| 4,245,791 | * | 1/1981 | Ivanov et al. | 241/207 |
| 4,272,030 | * | 6/1981 | Afanasiev et al. | 241/37 |
| 4,478,373 | | 10/1984 | Gieschen | 241/208 |
| 4,592,517 | * | 6/1986 | Zarogatsky et al. | 241/207 |
| 4,615,491 | | 10/1986 | Batch et al. | 241/37 |
| 4,697,745 | | 10/1987 | Sawant et al. | 241/30 |
| 4,844,362 | * | 7/1989 | Revnivtsev et al. | 241/210 |
| 5,312,053 | | 5/1994 | Ganser, IV | 241/30 |
| 5,718,391 | | 2/1998 | Musil | 241/207 |
| 5,779,166 | | 7/1998 | Ruokonen et al. | 241/213 |
| 5,927,623 | * | 7/1999 | Ferguson et al. | 241/36 |

FOREIGN PATENT DOCUMENTS

| | | |
|---|---|---|
| 161632 | 7/1904 | (DE) . |
| 801091 | 9/1958 | (GB) . |

OTHER PUBLICATIONS

Allis Mineral Systems, The New Generation H–3000, H–4000, and H–6000 Hydrocone Crushers, Catalog No. 17B0018–02–9301, pp. 1–8 (No Date).
Allis Mineral Systems, The New Generation S–3000 & S–4000 Superior Crushers, Catalog No. 17B0023–9201, pp. 1–8 (No Date).
Pegson Telsmith, Autocone—Series 2, pp. 1–12 (No Date).

* cited by examiner

*Primary Examiner*—John M. Husar
(74) *Attorney, Agent, or Firm*—McDermott, Will & Emery

(57) ABSTRACT

A variable throw eccentric cone crusher. The cone crusher comprises a frame, a crusher head supported on the frame for gyration about a first axis, a bowl supported on the frame in spaced relation to the crusher head, and a mechanism on the frame for varying the eccentricity of the gyration of the crusher head. An eccentric member engages the crusher head and is eccentrically pivotable about a second axis radially offset from the first axis. The eccentric member is adjustable to vary the eccentricity of the gyration of the crusher head.

30 Claims, 6 Drawing Sheets

VARIABLE THROW ECCENTRIC CONE CRUSHER AND METHOD FOR OPERATING THE SAME

FIELD OF THE INVENTION

The present invention generally relates to the field of crushers used to crush aggregate or ore into smaller pieces. More specifically, the present invention relates to cone crushers which afford variation of the throw and speed of the crusher and a method for operating such crushers.

BACKGROUND OF THE INVENTION

1. Technical Field

Crushers are used to crush larger aggregate and ore particles (e.g., rocks) into smaller particles. One particular type of crusher is known as a cone crusher. A typical cone crusher includes a frame supporting a crusher head and a mantle secured to the head. A bowl and bowl liner are supported by the frame so that an annular space is formed between the bowl liner and the mantle. In operation, larger particles are fed into the annular space between the bowl liner and the mantle. The head, and the mantle mounted on the head, gyrate about an axis, causing the annular space to vary between a minimum and a maximum distance. As the distance between the mantle and the bowl liner varies, the larger particles are impacted and compressed between the mantle and the bowl liner. Through a series of blows, the particles are crushed and reduced to the desired product size, and then discharged from between the mantle and the bowl liner.

The throw of the cone crusher is the difference of the maximum distance between the bowl liner and the mantle (the open side setting) and the minimum distance between the bowl liner and the mantle (the closed side setting). Typically, the throw of a cone crusher is set by the degree of eccentricity of the eccentric member which transforms the rotational motion of a drive member into the gyrating motion of the head and mantle. It is possible, however, to vary the throw of the cone crusher. To change the throw in such a typical cone crusher, an eccentric member with a different degree of eccentricity must be substituted for the original eccentric member.

2. Related Prior Art

U.S. Pat. No. 5,312,053, which issued to Ganser, IV, discloses a cone crusher with adjustable stroke. In this cone crusher, a stroke control assembly is adjustable to change the angular motion of the crusher head relative to the central crusher axis to change the stroke (or throw) of the crusher head with respect to the bowl assembly.

SUMMARY OF THE INVENTION

One of the problems with existing cone crushers is that the adjustment of the throw (if possible) may require extensive down time. For example, a substitution of eccentric support members requires the disassembly of the cone crusher, removal of the original eccentric support member (and possibly other components), replacement of the new eccentric support member (and other components, if necessary), and re-assembly of the cone crusher. This substitution causes a loss in production time and a corresponding increase in the cost of production. In addition, an inventory of different eccentric support members must be kept on hand.

To overcome the problems associated with existing cone crushers, the present invention provides a variable throw eccentric cone crusher. More particularly, the present invention provides a cone crusher comprising a frame, a crusher head supported on the frame for gyrating motion about an axis, a bowl supported on the frame in spaced relation to the crusher head, and means supported on the frame for varying the eccentricity of the gyration of the crusher head.

The means for varying the eccentricity may include an eccentric member supporting the crusher head and being eccentrically pivotable about a second axis angularly offset from the first axis. Preferably, the eccentric member has an outer surface with a circular cross-section, and the outer surface is eccentric with respect to the second axis. The cone crusher may further comprise a second eccentric member defining the second axis and being eccentrically rotatable about the first axis.

Also, the means for varying the eccentricity may preferably include an inner eccentric member supported by the frame for eccentric rotation about the axis, and an outer eccentric member pivotably supported by the inner eccentric member for eccentric movement relative to and about the inner eccentric member. The outer eccentric member supports the crusher head and is pivotable relative to the first eccentric member to vary the eccentricity of the gyration of the crusher head.

Preferably, the outer surface of the inner eccentric member defines an inner eccentric member centerline, and the outer eccentric member is eccentrically pivotable about the inner eccentric member centerline. Also, the outer surface of the outer eccentric member defines an outer eccentric member centerline. The inner eccentric member centerline, the outer eccentric member centerline and the crusher axis extend through a fixed point, the virtual pivot point of the crusher head.

Further, the cone crusher preferably comprises a drive mechanism for rotatably driving the inner eccentric member and the outer eccentric member together to gyrate the crusher head. In addition, a fixed center support shaft preferably defines the crusher axis.

The cone crusher also preferably comprises a locking assembly operable to prevent relative rotation of the inner eccentric member and the outer eccentric member. The outer surface of the inner eccentric member and the inner surface of the outer eccentric member are preferably tapered so that a locking taper is formed therebetween to prevent relative rotation of the inner eccentric member and the outer eccentric member during crusher operation. The cone crusher also preferably comprises an indicator for indicating the pivoted position of the outer eccentric member relative to the inner eccentric member and, thereby, indicating the amount of throw. A lubrication system preferably provides lubricant between relatively moving surfaces of the cone crusher.

A method for maximizing the production capacity is also provided by the present invention. The method of operating the crusher permits optimization of crusher performance and product yield through recognition of the more significant variables that affect the performance of the crusher, and through recognition of the relationships between these factors. One aspect of the invention is the selection of a maximum power rating of the crusher drive and operation of the drive at 100% of the power rating. Another aspect of the invention is the isolation of power-related variables and product related variables which are present in crushing operations, and variation of speed and throw settings, i.e., crusher-related variables to optimize the resultant crusher operation and product yield.

Also, the present cone crusher is designed such that productivity is limited only by the selected horsepower applied to the crusher. Traditional cone crushers are designed such that either the crushing force or the volumetric capacity are reached before the maximum horsepower limit for the cone crusher is attained. This hierarchy of design criteria ensures that the cone crusher can be operated at the full power, and affords variation of the volumetric capacity to optimize thruput tonnage capacity.

One advantage of the present invention is that the throw of the cone crusher is infinitely adjustable between the maximum and the minimum amounts of throw. In this manner, the operation of the cone crusher can be optimized.

Another advantage of the present invention is that throw of the cone crusher is more easily adjustable.

Yet another advantage of the present invention is that the crusher head is better supported at each setting for throw because the eccentric members are moved rotationally rather than axially or angularly with respect to the central crusher axis.

A further advantage of the present invention is that adjustment of the throw of the cone crusher does not require extensive disassembly and re-assembly of the cone crusher. This reduces the down time of the cone crusher and the costs associated with operating the cone crusher.

Another advantage of the present invention is that additional eccentric support members are not required to be kept on hand, reducing the required storage and operating space for the cone crusher.

Yet another advantage of the present invention is that the center support shaft bears a significant portion of the lateral load generated during crushing operations.

A further advantage of the present invention is that the centerline of the center support shaft is aligned with the central crusher axis about which the crusher head gyrates. Also, the center support shaft cooperates with the frame socket to locate the eccentric assembly and the crusher head. This arrangement makes assembly and disassembly of the crusher easier and less complex. Further, the crusher components do not require significant adjustment and alignment before operation.

Another advantage of the present invention is that the lubrication system is provided through the center support shaft to provide a less complex system.

Yet another advantage of the present invention is to provide a method for optimizing the production capacity of a crusher.

Other features and advantages of the invention will become apparent to those skilled in the art upon review of the following detailed description, claims and drawings.

Figure 1:
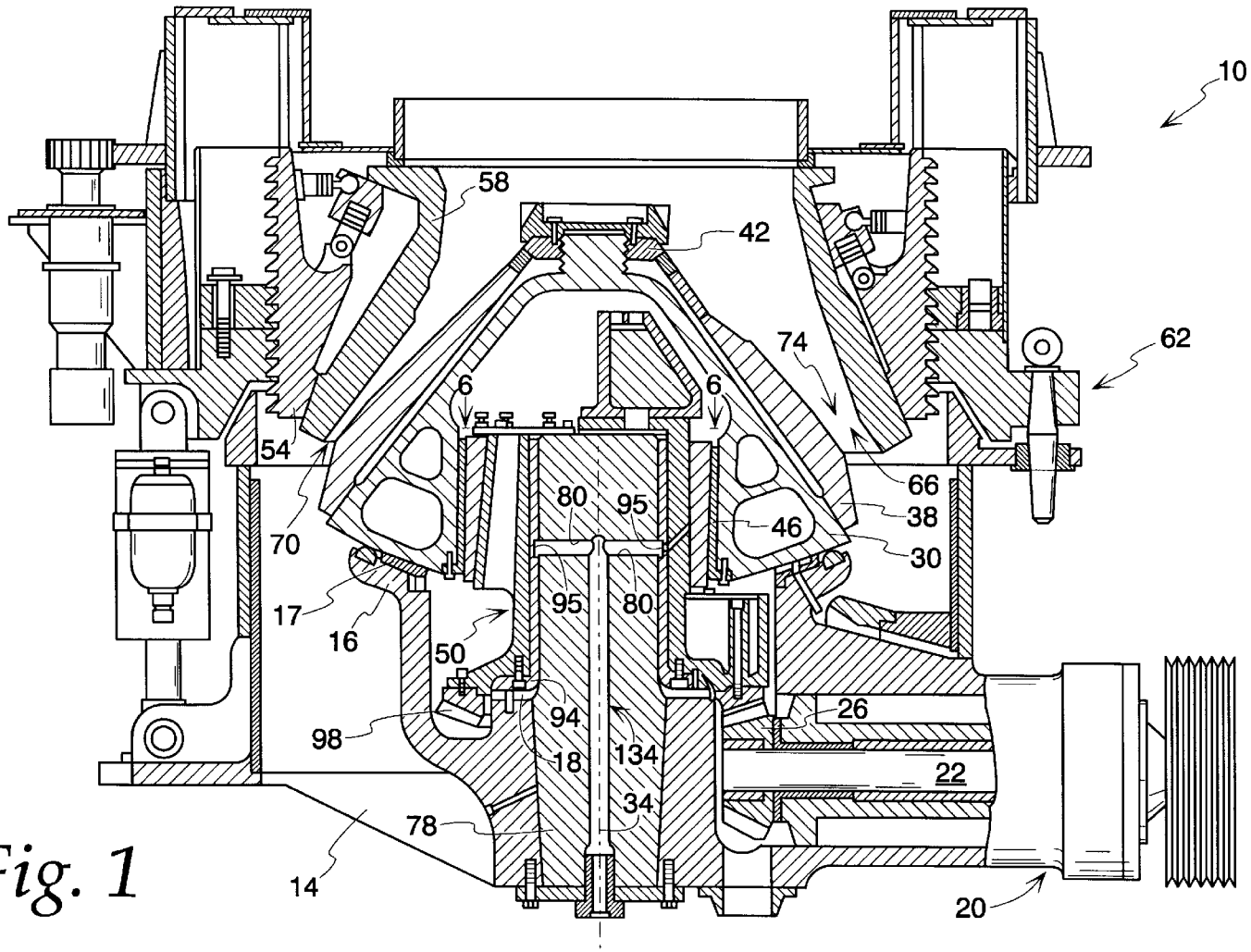
FIG. 1 is a cross-sectional view of a cone crusher embodying the present invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

A cone crusher 10 embodying the invention is illustrated in the drawings. As shown in FIG. 1, the cone crusher 10 includes a frame 14 defining a socket 16. A socket liner 17 mounted in the socket 16 and a thrust bearing 18 mounted on the frame 14 provide respective bearing surfaces. The cone crusher also includes a drive system 20 (a portion of which is shown in FIG. 1) including a drive shaft 22 and a drive pinion 26 mounted on one end of the drive shaft 22. A prime mover (not shown) rotatably drives the drive shaft 22 and drive pinion 26.

The cone crusher 10 further includes a crusher head 30 slidably and rotatably supported in the socket 16 by the socket liner 17. The socket liner 17 bears a substantial portion of the vertical load of the head 30 and provides a sliding contact with the lower portion of the head 30. The head 30 is driven by the drive system 20 for gyration or eccentric rotation about a central crusher axis 34.

A mantle 38 is mounted on the outer surface of the head 30 and provides a generally frusto-conical crushing surface. In the illustrated construction, the mantle 38 is secured to the head 30 by a lock ring 42 which threadedly engages an upper portion of the head 30 and engages the mantle 38. An annular bushing 46 is mounted on the inner surface of the head 30 and provides a sliding contact surface. The cone crusher 10 also includes an eccentric assembly 50 laterally locating the head 30 and determining the eccentricity of the gyration of the head 30, as explained more fully below.

The cone crusher 10 further includes a bowl 54 and a bowl liner 58 mounted on the bowl 54. The bowl liner 58 provides another generally frusto-conical crushing surface. An adjustment ring 62 is supported on the frame 14 in a conventional manner and supports the bowl 54 and bowl liner 58 so that the bowl 54 and bowl liner 58 are movable along the axis 34 relative to the head 30 and mantle 38. In this manner, an adjustable annular space 66 is formed between the mantle 38 and the bowl liner 58.

Due to the gyration of the head 30 and mantle 38, the annular space 66 has a minimum spacing, or closed side setting 70 (shown on the left in FIG. 1), and a maximum spacing, or open side setting 74 (spaced 180° from the closed side setting 70 and shown as being on the right in FIG. 1). The difference between the minimum spacing and the maximum spacing, at a given eccentricity of the rotation of the head 30, is the throw T of the cone crusher 10 (illustrated in FIGS. 2 and 4 as the change in position between the outer surface of the head 30 relative to the bowl liner 58 (depicted in solid lines and in phantom lines)). In the illustrated construction, the throw T of the cone crusher 10 is infinitely adjustable between a maximum throw $T_{max}$ of 110 mm (illustrated in FIG. 2) and a minimum throw $T_{min}$ of 75 mm (illustrated in FIG. 4), as explained below.

The eccentric assembly 50 includes (see FIG. 1) a fixed center support shaft 78 connected to the frame 14 and defining the axis 34. The shaft 78 provides lateral load bearing support for the eccentric assembly 50 and for the head 30. The shaft 78 cooperates with the socket 16 to locate the eccentric assembly 50 and the head 30 as the crusher 10 is assembled. A conduit 80 extends from the base of the shaft 78 and through the outer surface of the upper end of the shaft 78 in at least two points spaced on opposite sides of the axis 34. The purpose of the conduit 80 is explained more fully below.

Figure 5:
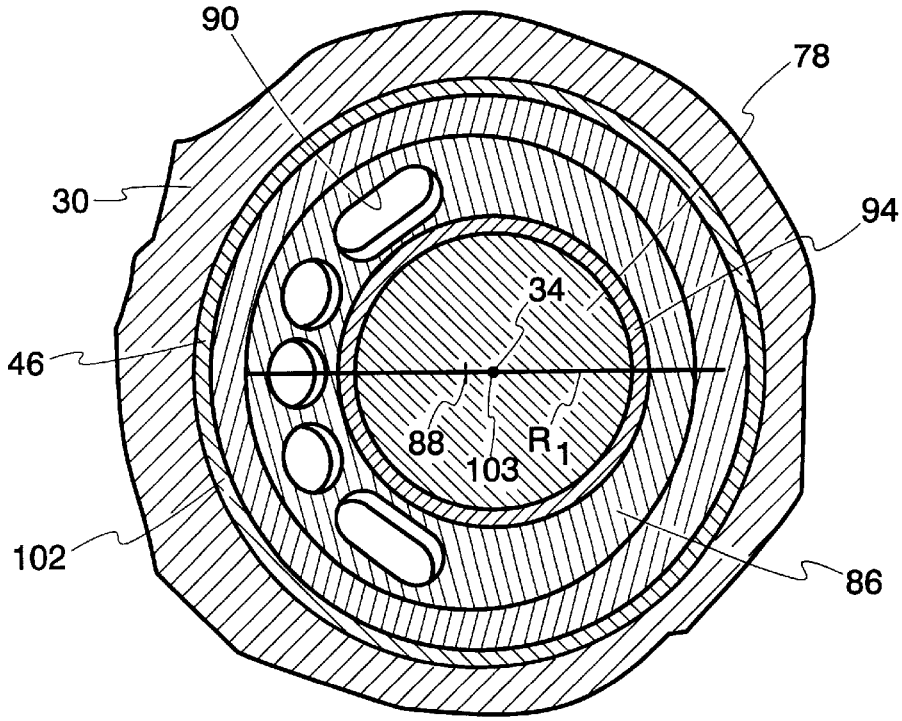
FIG. 5 is a cross-sectional view taken generally along line 5—5 in FIG. 4.

The eccentric assembly 50 also includes (see FIGS. 2–5) means 82 for varying the eccentricity of gyration of the head 30 or, in other words, for varying the throw T of the cone crusher 10. The variable throw means 82 includes an inner eccentric member 86 rotatably supported by the shaft 78. As shown in FIGS. 3 and 5, the inner eccentric 86 has an outer surface that has a circular cross-section and that is eccentric relative to the axis 34. Preferably, the inner eccentric 86 is annular, and the wall thickness of the inner eccentric 86 varies from a minimum thickness (on the right side in FIGS. 3 and 5) to a maximum thickness (on the left side in FIGS. 3 and 5) opposite the minimum thickness.

Figure 2:
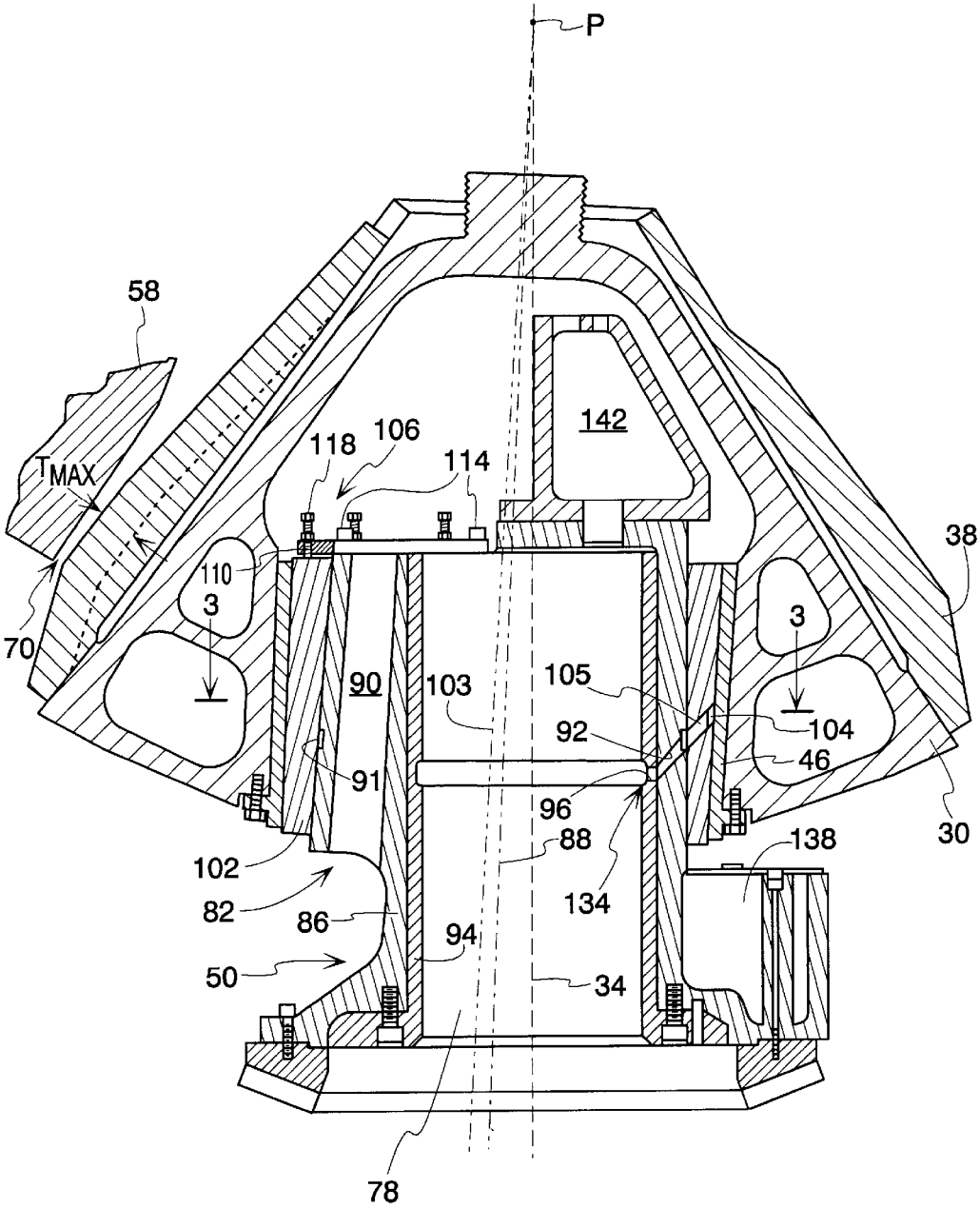
FIG. 2 is a cross-sectional view of a portion of the cone crusher illustrated in FIG. 1 and illustrating the maximum throw.
Figure 3:
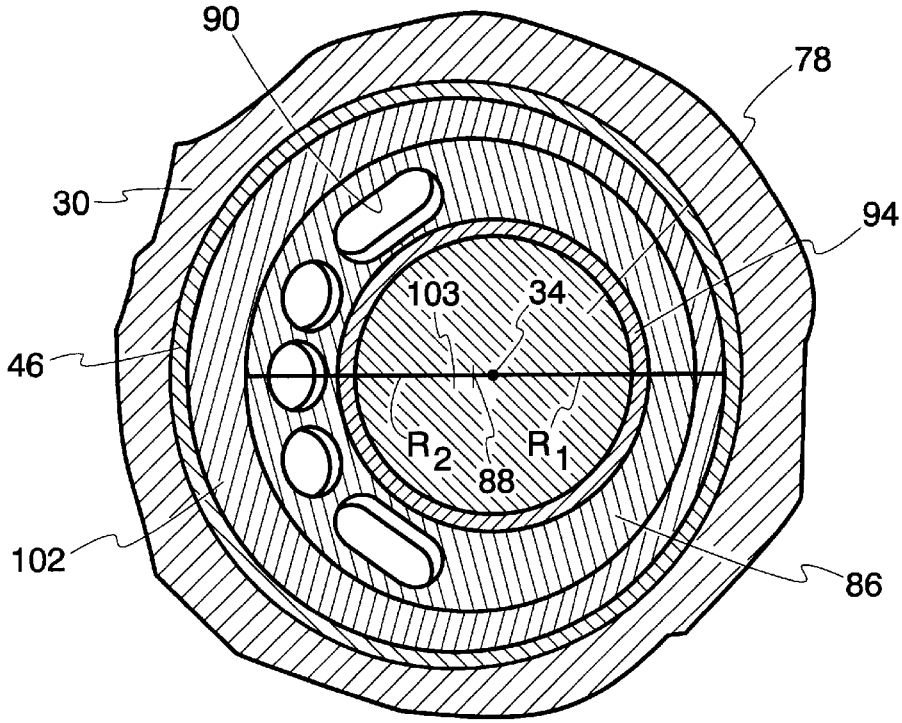
FIG. 3 is a cross-sectional view taken generally along line 3—3 in FIG. 2.
Figure 4:
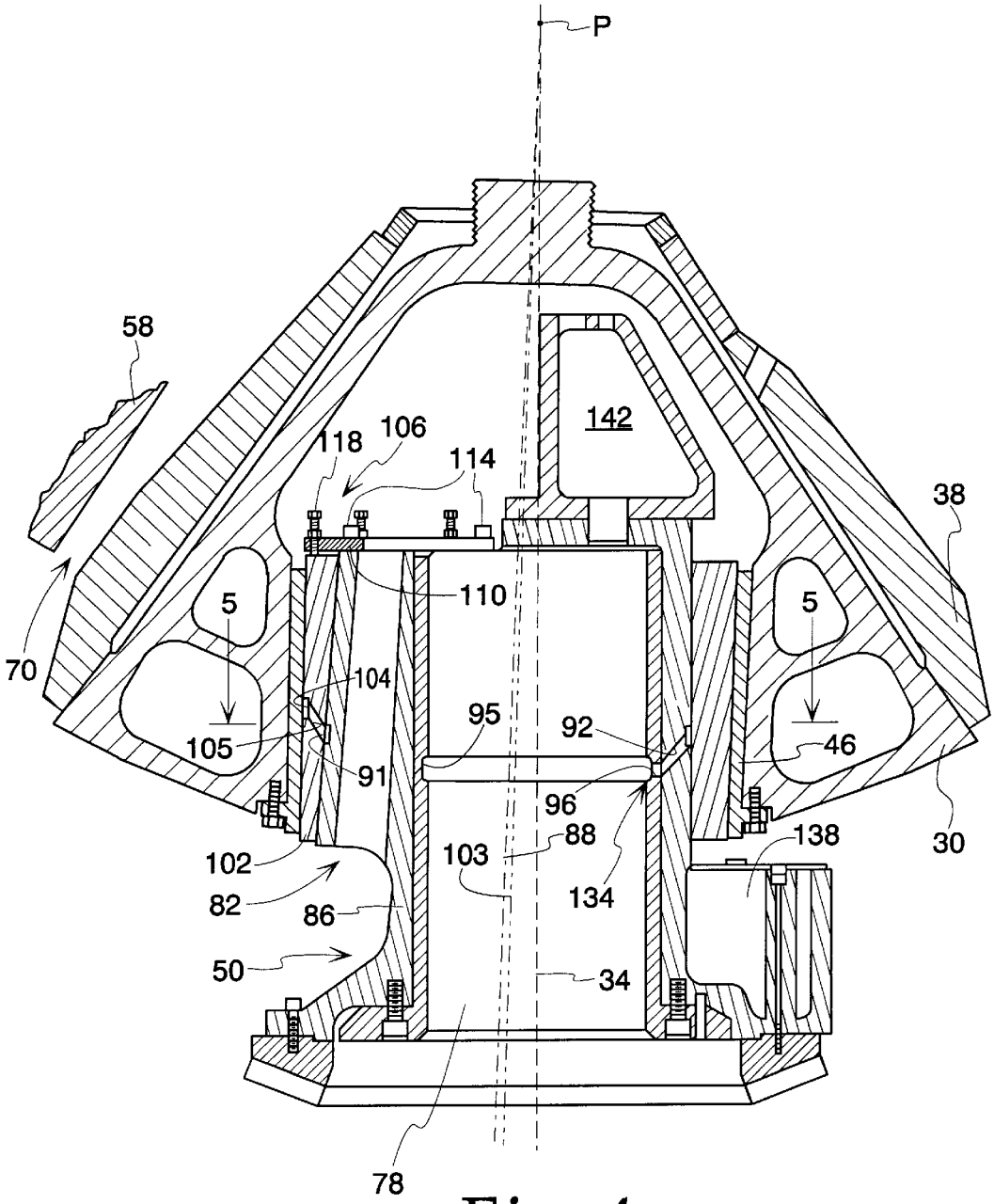
FIG. 4 is a partial cross-sectional view of a portion of the cone crusher illustrated in FIG. 1 and illustrating the minimum throw of the cone crusher.

As shown in FIGS. 2 and 4, the outer surface of the inner eccentric 86 defines an inner eccentric centerline 88. The inner eccentric member centerline 88 defines an axis that is radially and angularly offset from the axis 34. In other constructions (not shown), the shaft 78 and the inner eccentric 86 may be provided by a single rotatable member having an eccentric outer surface.

The outer surface of the inner eccentric 86 is preferably tapered relative to vertical so that the inner eccentric 86 is frusto-conical in shape. The angle of taper is preferably less than 7° from vertical and, most preferably, between 3° and 6° from vertical. The reason for the taper is explained more fully below. In other constructions, the outer surface may not be tapered, and the inner eccentric 86 may be cylindrical in shape.

Preferably, the inner eccentric 86 is formed of cast ductile iron, and openings 90 are defined in the inner eccentric 86 to reduce its weight. A groove 91 (partially shown in FIGS. 2 and 4) is formed in the outer surface of the inner eccentric 86 and extends 360° about the circumference of the inner eccentric 86. In other constructions (not shown), the groove 91 extends at least approximately 190° about the circumference of the inner eccentric 86. A conduit 92 extends through the inner eccentric 86 connecting the inner surface of the inner eccentric 86 to the groove 92. The purposes for the groove 91 and the conduit 92 are explained more fully below.

An annular bushing 94 is connected to the inner surface of the inner eccentric 86. The bushing 94 provides a sliding contact surface against the shaft 78 and against the thrust bearing 18. A groove 95 is formed in the inner surface of the bushing 94 and extends at least approximately 190° about the inner circumference of the bushing 94 so that the groove 95 communicates with the conduit 80 in at least one point (as shown in FIG. 1). A conduit 96 (see FIGS. 2 and 4) extends through the bushing 94 connecting the groove 95 to the conduit 92 in the inner eccentric 86. The purposes for the groove 95 and the conduit 96 are explained more fully below.

As shown in FIG. 1, a ring gear 98 is connected to the bottom portion of the inner eccentric 86. The gear 98 meshes with the drive pinion 26 so that the inner eccentric 86 is rotatably driven by the drive system 20.

The variable throw means 82 also includes an outer eccentric member 102 supported by the inner eccentric 86 for pivotal movement relative to the inner eccentric 86 and about the inner eccentric member centerline 88. As shown in FIGS. 3 and 5, the outer eccentric 102 has an outer surface that has a circular cross section and that is eccentric with respect to the inner eccentric member centerline 88. Similarly to the inner eccentric 86, the outer eccentric 102 is preferably annular, and the wall thickness of the outer eccentric 102 varies from a minimum thickness (to the right in FIG. 3) to a maximum thickness (to the left in FIG. 3) opposite the minimum thickness.

As shown in FIGS. 2 and 4, the outer surface of the outer eccentric 102 defines an outer eccentric member centerline 103. The outer eccentric member centerline 103 defines an axis that is radially and angularly offset from and movable relative to the axis 34. The inner surface of the outer eccentric 102 preferably has a circular cross-section and is complementary to the outer surface of the inner eccentric 86. The inner surface of the outer eccentric 102 is also preferably tapered relative to vertical. As with the outer surface of the inner eccentric 86, the angle of taper of the inner surface of the outer eccentric 102 is preferably less than 7° from vertical and, most preferably, between 3° and 6° from vertical. The reason for the taper is explained more fully below.

Preferably, the outer eccentric 102 is formed of cast ductile iron. A groove 104 is formed in the outer surface of the outer eccentric 102 and extends approximately 110° about the circumference of the outer eccentric 102. Vertically-extending grooves (not shown) are also formed in the outer surface of the outer eccentric 102 and extend approximately 90% of the height of the outer eccentric 102. The vertically-extending grooves communicate with the groove 104 to form a generally "H" shaped pattern. A conduit 105 extends through the outer eccentric 102 connecting the inner surface of the outer eccentric 102 to the groove 104. The conduit 105 communicates with a portion of the groove 91 formed in the outer surface of the inner eccentric 86. The purposes for the groove 104 and the conduit 105 are explained more fully below.

The cone crusher 10 also includes (see FIGS. 2 and 4) a locking assembly to prevent rotation of the outer eccentric 102 relative to the inner eccentric 86 except when the throw of the cone crusher 10 is being adjusted. As explained above, the outer surface of the inner eccentric 86 and the inner surface of the outer eccentric 102 are tapered relative to the vertical so that a locking taper is formed. In this manner engagement of the outer surface of the inner eccentric 86 with the inner surface of the outer eccentric 102 prevents unwanted rotation of the outer eccentric 102 relative to the inner eccentric 86.

Preferably, the locking assembly includes a locking mechanism 106 that is operable to exert a downward force on the top of the outer eccentric 102 to ensure engagement of the outer eccentric 102 and the inner eccentric 86. The locking mechanism 106 includes a first locking member or lock plate 110 conventionally connected to the inner eccentric 86 (by fasteners 114, in the illustrated construction). The locking mechanism 106 also includes a plurality of second locking members 118 angularly spaced apart adjacent the outer periphery of the lock plate 110. The second locking members 118 selectively apply downward pressure to the upper surface of the outer eccentric 102 to provide additional security against unwanted rotation of the outer eccentric 102 relative to the inner eccentric 86. In the illustrated construction, the second locking members 118 engage the upper surface of the outer eccentric 102. In other constructions (not shown), however, the second locking members 118 may engage a recess in the upper surface of the outer eccentric 102. In the above-described manner, the locking assembly ensures that the outer eccentric 102 is releasably fixed with the inner eccentric 86.

Figure 6:
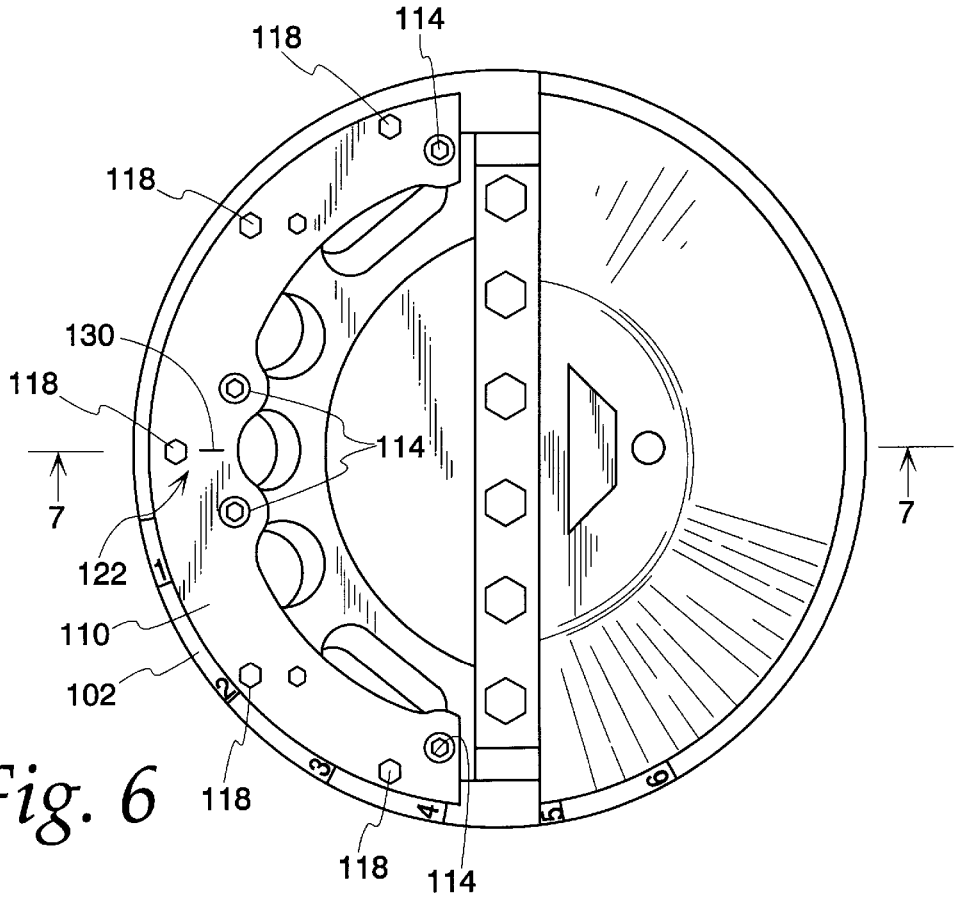
FIG. 6 is a top view of the means for varying the throw of the cone crusher taken generally along line 6—6 shown in FIG. 1 and illustrating the locking assembly and the indicator.
Figure 7:
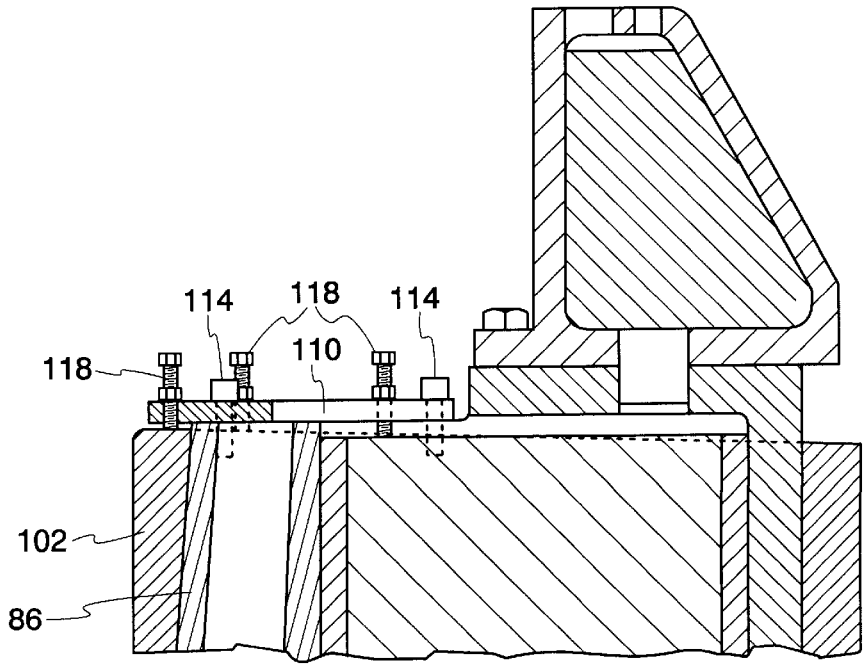
FIG. 7 is a side partial cross-sectional view of the means for varying the throw of the cone crusher taken generally along line 7—7 shown in FIG. 1 and illustrating the locking mechanism.

The cone crusher 10 also includes (see FIG. 6) an indicator 122 for indicating the relative rotational position of the outer eccentric 102 and the inner eccentric 86. In the illustrated construction, the indicator 122 includes a first indicator member or reference member 126 on the upper portion of the lock plate 110 adjacent to the outer surface. The indicator 122 also includes a plurality of second indicator members 130 formed on the upper portion of the outer eccentric 102 and spaced apart, in the illustrated construction, through 135° of the inner circumference of the outer eccentric 102. Alignment of the first indicator member 126 with one of the second indicator members 130 corresponds to a specified setting of throw T of the cone crusher 10 between the minimum throw $T_{min}$ (shown in FIG. 5) and the maximum throw $T_{max}$ (shown in FIG. 3). In the illustrated construction, the second indicator members 130 are spaced apart in 10° increments corresponding to an evenly divided change of the throw T of the cone crusher 10.

In other constructions, the indicator 122 may cooperate with the locking mechanism 106 to indicate specified amounts of throw T. For example, one of the second locking members 118 may operate as the first indicator member 126, and recesses (not shown) formed on the upper portion of the outer eccentric 102 may operate as the second indicator members 130. In this described construction, the second locking member 118 would extend into a given recess to indicate a specific setting of throw T.

The cone crusher 10 also includes (see FIGS. 1, 2 and 4) a lubrication system 134 for lubricating the surfaces between the relatively moving parts in the cone crusher 10. The lubrication system 134 includes a lubricant source (not shown). The lubricant source provides lubricant to the conduit 80. Lubricant flows from conduit 80 to groove 95 to lubricate the bushing 94 and the outer surface of the shaft 78. Lubricant also flows through the conduit 96, through the conduit 92, through the groove 91, through the conduit 105, into the groove 104, and into the vertically-extending grooves to lubricate the outer surface of the outer eccentric 102 and the inner surface of the bushing 46.

Because the groove 91 extends 360° about the circumference of the inner eccentric 86 and the groove 95 extends at least 190° about the circumference bushing 94, the lubrication system 134 is able to provide lubricant to the required relatively moving surfaces as the inner eccentric 86 rotates and at any positional setting of the outer eccentric 102 relative to the inner eccentric 86. In addition, the "H" shaped pattern formed by the groove 104 and the vertically-extending grooves provides improved distribution of lubricant between the outer eccentric 102 and the bushing 46. By providing lubricant to a substantial portion of the inner surface of the bushing 46, the likelihood of damage to the bushing 46 resulting from the load created during crushing operations is greatly reduced. Also, because, in the illustrated construction, the shaft 78 is fixed, the lubrication system 134 is less complex. In summary, the lubrication system 134 enhances the rotation of the bushing 94, the inner eccentric 86, and the outer eccentric 102 relative to both the shaft 78 and the crusher head 30 and the bushing 46.

The cone crusher 10 also includes a counterweight assembly to counteract the forces resulting from the gyration of the head 30 and the eccentric assembly 50. A first counterweight 138 is supported on the side of the inner eccentric 86 radially closest to the axis 34. Similarly, a second counterweight 142 is supported on top of the eccentric assembly 50 on the side of the eccentric assembly 50 radially closest to the axis 34.

FIGS. 2 and 3 illustrate the cone crusher 10 set to the maximum throw $T_{max}$. It should be understood that the dimensions of the components have been exaggerated to illustrate the invention. The outer eccentric 102 and the inner eccentric 86 are arranged so that the thickest portion of the outer eccentric 102 and the thickest portion of the inner eccentric 86 are adjacent and so that the corresponding thinnest portions are also adjacent to each other. In this position, the eccentric assembly 50 has, relative to the axis 34, a minimum first radius $R_1$ and a maximum second radius $R_2$ so that the difference between $R_1$ and $R_2$ is at a maximum. Also in this position, the outer eccentric member centerline 103 is radially and angularly offset from the axis 34 by the greatest amount for the illustrated construction.

FIGS. 4 and 5 illustrate the cone crusher 10 set to the minimum throw $T_{min}$. It should be understood that the dimensions of the components have been exaggerated to illustrate the invention. The outer eccentric 102 and the inner eccentric 86 are arranged so that the thinnest portion of the outer eccentric 102 and the thickest portion of the inner eccentric 86 are adjacent and so that, correspondingly, the thickest portion of the outer eccentric 102 and the thinnest portion of the inner eccentric 86 are adjacent. In this position, the eccentric assembly 50 has, relative to the axis 34, a maximum first radius $R_1$ and a minimum second radius $R_2$ so that the difference between $R_1$ and $R_2$ is at a minimum. Also in this position, the outer eccentric member centerline 103 is radially and angularly offset from the axis 34 by the least amount for the illustrated construction.

In operation, the throw T of the cone crusher 10 and the corresponding eccentricity of the gyration of the crusher head 30 is set. The drive system 20 drives the inner eccentric 86 about the shaft 78 and about the axis 34. Due to the eccentric arrangement of the inner eccentric 86 and the outer eccentric 102, the head 30 gyrates about the axis 34.

To change the eccentricity of the head 30 and to vary the throw T of the cone crusher 10, the head 30 and second counterweight 142 are removed so that the inner eccentric 86 and outer eccentric 102 are accessible. The locking mechanism 106 is released so that the second locking members 118 do not engage the upper surface of the outer eccentric 102. The outer eccentric 102 is then lifted and rotated relative to the inner eccentric 86 to the desired throw T, as indicated by the indicator 122. The second locking members 118 of the locking mechanism 106 are operated to engage the upper surface of the outer eccentric 102 to lock the outer eccentric 102 in the desired position. The cone crusher 10 is then operated at the adjusted eccentricity and throw T.

As the eccentricity and throw T are adjusted, the inner eccentric center line 88, the outer eccentric center line 104 and the axis 34 all extend through the virtual pivot point P of the head 30. This ensures that, for a given eccentricity or throw T, the eccentricity and throw T are constant throughout the 360° of rotation of the head 30.

During operation of the cone crusher 10, larger particles are fed into the annular space 66 and are impacted between the mantle 38 and the bowl liner 58. The crushing load is transmitted through the head 30 with the vertical component transmitted to the socket liner 17 and the horizontal component transmitted to the eccentric assembly 50. Due to the non-vertical outer surface of the inner eccentric 86, the horizontal component of the crushing load is further transmitted with a vertical component transmitted to the thrust bearing 16 and a horizontal component transmitted to the shaft 78.

As explained in more detail below, production capacity of the crusher 10 can be maximized by adjusting the reduction ratio and/or thruput tonnage of the crusher 10 to achieve maximum horsepower draw for the system. In general, horsepower draw is increased when either the thruput tonnage is increased while the reduction ratio of the processed aggregate is held constant, or the thruput tonnage is held constant while the reduction ratio is increased, or a combination of the two.

Further in this regard, the invention also includes a method of operating a crusher, such as crusher 10, to optimize crusher performance under a variety of conditions. The method of operating the crusher 10 requires recognition of the various factors which influence crusher performance, and the relationships between these factors. By understanding which factors are independently variable and the relationship of these variables to crusher performance, the operation of the crusher for maximum production of a particular product can be achieved.

The requirements for the final crushed product determine several significant conditions affecting crusher performance. For example, as discussed more particularly below, the type and initial size gradation of the aggregate or ore to be crushed (feed), and the size gradation of the desired finished product determine, in part, several operating conditions of the crusher. These factors are independently variable, and are considerations in the determination of the appropriate set-up and operation of the crusher.

More particularly, with respect to these "feed-based" variables and their effects on crusher performance, crushing force ("F") is the force applied to the feed to reduce or crush the feed into a product. The force required to crush a particular grade of feed varies with the type of feed, i.e., the toughness and the type of rock. One measure of the toughness of a particular type of feed is the unit energy or "Impact Work Index" ("IWI") (measured in units of energy per unit weight) required to crush the rock. Thus, the crushing force required to be applied by a cone crusher is a function of the feed type to be processed and is relative to the IWI of the feed type.

The required crushing force F also varies with the "reduction ratio" ("RR") of the feed and product, i.e., the relationship between the size gradation of the input feed and the resultant size gradation of the product. In general, the crushing force required for processing a particular feed increases with the increase in the reduction ratio. Simply stated, reduction of larger sized rocks to medium sized rocks entails a lower reduction ratio and uses a lesser amount of force than reduction of the same larger sized rocks to small rocks. Thus, the required crushing force is a function of the reduction ratio of the feed and crushed product.

Also, crushing force generally increases as the size of the input feed decreases, i.e., the unit energy required to crush a rock increases as the top feed size of the rock gets smaller. This phenomenon results because rocks generally break along planes of weakness, and fewer such planes are available as the rocks are reduced in size. A consequence of the inversely proportional relationship between feed size and required crushing force is that average crushing force is greater during secondary crushing cycles relative to that required for the preceding, primary crushing cycle. Similarly, the crushing force for a tertiary crushing stage is generally higher than that required for the secondary stage.

A further consequence of the sequential crushing of feed through multiple crushing stages is the increased presence of fines in the feed. "Clean" feed will not have many fines. However, in general, fines increase with progression of the rock through the stages of crushing, and the voids between the rock particles become smaller. As a result, in the case of multiple sequential crushing stages there is an increased tendency for the feed to become packed in the crusher. Moisture content of the feed can also effect packing conditions. Packing conditions also tend to increase the crushing force needed to process the feed.

Last, the possibility of "tramp" in the feed will also affect crushing force required to process a stream of aggregate or ore. If the feed is not homogeneous and/or includes unusually tough particulates, greater crushing force will be needed to process the feed. Thus, the required crushing force F is also a function of the size of the feed to be processed and is affected generally by how many stages of crushing will be performed, the relative "cleanliness" and moisture content of the feed, and the presence of tramp.

In view of the foregoing, crushing force is a function of the following feed-related variables: the relevant Impact Work Index ("IWI"), reduction ratio ("RR"), initial feed size, crushing stage, the relative "cleanliness" and moisture content of the feed, and the presence of tramp, collectively referred to as "Initial Feed Quality" ("IFQ"). This relationship between crushing force and the various feed-related variables can be expressed as follows:

$$F=f(IWI,RR, IFQ) \quad (1)$$

Several other significant variable factors influencing crusher performance result from the design criteria used to construct the crusher, and other performance affecting factors vary according to the operational settings of the crusher. With respect to these crusher-related variables, as opposed to feed-related factors, the design and construction of a cone crusher necessarily entails the delineation of several parameters which limit the production capacity of the crusher. In no particular order, three design parameters are the maximum crushing force Fmax the crusher can apply; the maximum volumetric capacity VCmax of the crusher; and the maximum power rating Pmax of the crusher's drive mechanism. In the analysis of a cone crusher's optimal operational capacity, any one of these parameters can limit the operational capacity of the crusher. Preferably, all three parameters, Fmax, VCmax and Pmax, are maximized to optimize the production capacity of the crusher.

Maximum crushing force ("Fmax") is the maximum force a given crusher construction can apply to the feed. Although several structural components of a cone crusher can limit the maximum crushing force Fmax of a cone crusher design, perhaps the most common factor is the maximum clamping force applied between the adjustment ring and main frame. In operating the crusher, the maximum crushing force Fmax should not be exceeded; otherwise, structural failure of the major components may result. Such failure can be difficult and expensive to repair.

Figure 9:
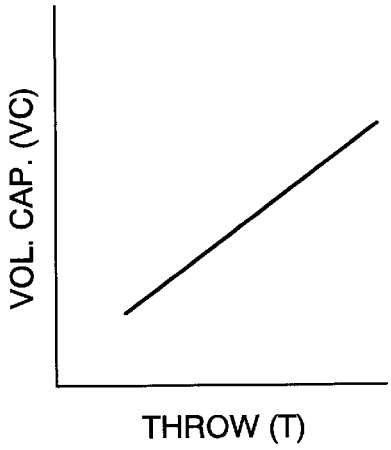
FIG. 9 illustrates the general relationship of volumetric capacity and throw of the crusher shown in FIG. 1.
Figure 10:
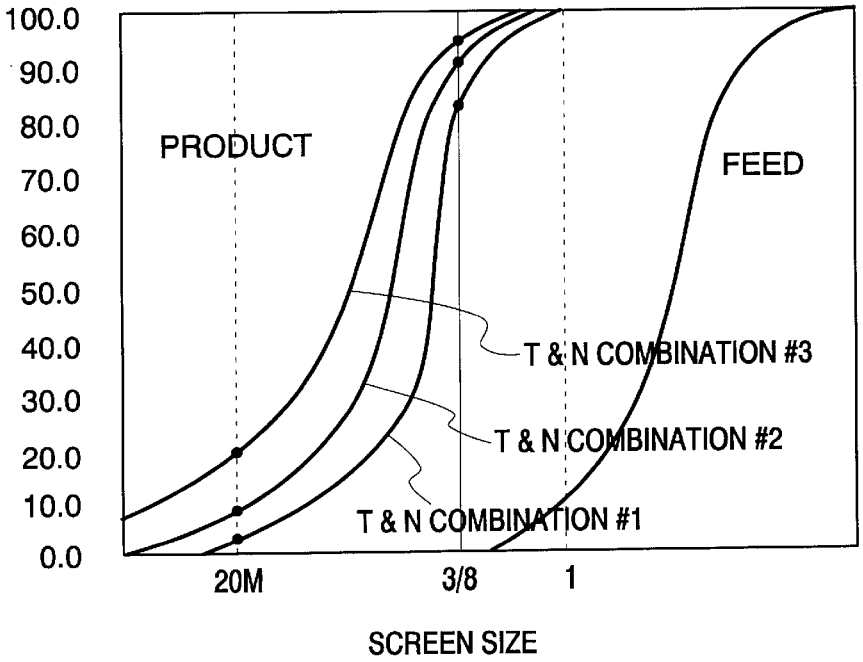
FIG. 10 illustrates the general relationship of production optimization of the crusher shown in FIG. 1 in terms of feed/product gradations and combinations of throw and speed settings.

The volumetric capacity ("VC") of a crusher is the total amount of feed per unit of time (tons of product per hour) that can pass through a crusher for a given operational configuration. In particular, a variety of independent variable operating settings affect the volumetric capacity VC of a crusher. For example, volumetric capacity varies as a function of throw setting ("T"), speed ("N"), closed side setting ("CSS") and liner configuration ("LC"). As shown in FIG. 9, volumetric capacity VC increases in a generally linear relationship with increases in throw T.

Figure 8:
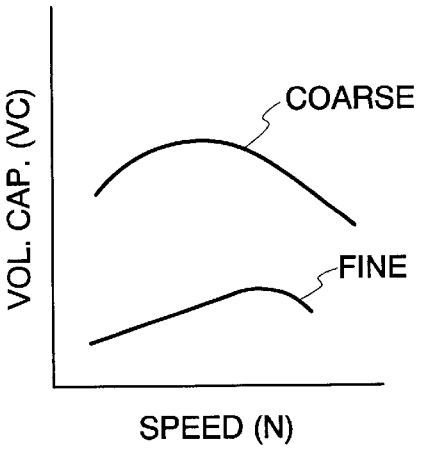
FIG. 8 illustrates the general relationship of volumetric capacity and operating speed the crusher shown in FIG. 1.

Volumetric capacity VC also varies with changes in crusher speed N as well, but not in a linear manner. See the relationship between volumetric capacity VC and speed N shown in FIG. 8. Rather, as shown in FIG. 8, depending on whether the feed is fine or coarse, changes in speed N can result in either an increase or a decrease in volumetric capacity. In general, this phenomenon results from the increased or decreased obstruction of the cavity by the gyrating head. Larger or more coarse feed will not readily fall into the crusher if the head gyrates too rapidly. In fine crushing applications, volumetric capacity VC tends to increase with increases in speed over a greater range of speeds before decreasing.

As to the relationship of volumetric capacity VC and closed side setting CSS, like the relationship between throw and volumetric capacity, volumetric capacity and closed side settings also vary in a directly linear manner. The closed side setting is, however, somewhat product-dependent as the range of closed side setting available for a particular product will be limited.

Last, as to liner configuration LC, volumetric capacity VC varies depending on angles of impact ("nip angle") provided by the liners. Cavity profiles will also predictably effect the volumetric capacity VC of a crusher. Like closed side setting, however, the selection of liner configuration is also somewhat product-dependent as the nip angles, expected flow path and size of feed will be determined by the desired product characteristics. Thus, volumetric capacity VC is a function of throw setting T, speed N, closed side setting CSS and liner configuration LC. This relationship can be expressed as:

$$VC=f(T, N, CSS, LC) \tag{2}$$

The production capacity of a crusher also varies with the power of the drive ("P"). Ideally, the rated power of the crusher's drive mechanism is selected to optimize the power usage of the drive, and volumetric capacity VC and crushing force F are determined so that the power P of the drive mechanism is the limiting factor. This approach is preferred because the drive mechanism can be run at full rated power under all circumstances without danger of exceeding the maximum crushing force of the crusher and, as explained below, affords variation of operational settings such as throw and speed to optimize the production capacity of the crusher for a variety of feeds and stages of production.

Preferably, the crusher 10 is constructed to afford operation with a high volumetric capacity, to assure that for a wide range of operating conditions, applications, the crusher can operate at its horsepower limit and permit variation of the throw T, speed N and closed side setting CSS.

More particularly, varying throw settings and the speed of a cone crusher with consideration to other operating parameters can optimize the power drawn by the system to assure that the drive system is operated at 100% of capacity. This can be achieved by recognizing the dependent relationship between the power draw and variations in throw and/or speed.

With respect to the relationship between power drawn and throw setting, for a given type of rock feed, the relationship between the reduction ratio and the energy required to crush a ton of the rock feed can be expressed by the following equation:

$$\frac{P}{VC}\cdot\frac{1}{RR}=K1 \tag{3}$$

where:

P=Power

VC=Volumetric Capacity

RR=Reduction Ratio.

K1 is a constant

Equation (3) can be rewritten as follows:

$$P=K1\cdot VC\cdot RR \tag{4}$$

Thus, for a given reduction ratio, an increase in throughput tonnage, i.e., an increase in VC requires an increase in power drawn by the crusher drive, i.e., an increase in rock crushed per unit time requires an increase in crushing energy applied per unit time. Similarly, throughput tonnage, i.e., VC may remain constant, and an increase in reduction ratio will result in a greater power draw.

We can also write the following equation based on the mechanical design formula:

$$P=K2\cdot F\cdot T\cdot N \tag{5}$$

where:

P=Power

F=Crushing Force

T=Throw

N=Speed

K2 is a constant

Combining equations (4) and (5), we can write the following equation:

$$K1\cdot VC\cdot RR=K2\cdot F\cdot T\cdot N \tag{6}$$

or $$F=\frac{K1}{K2}\cdot\frac{VC}{T}\cdot\frac{RR}{N} \tag{7}$$

If the crushing force F is held constant near the maximum allowable value, we can make the following conclusions:

(1) the present invention has the ability to vary both throw T and speed N, and, therefore, the present invention can control the volumetric capacity VC and the reduction ratio RR; and (2) depending on the application requirements, different combinations of throw T and speed N can be used to optimize the product yield, i.e. maximize the product tonnage and minimize the unwanted product fractions.

As a result, if power drawn is maintained as a constant, preferably at 100% of the drive's rating, and if crushing force (as solely determined by feed-related variables) is maintained constant by product requirements, optimizing changes in throughput tonnage can be achieved only through variation of crusher speed N and throw T. In other words, RR, CSS and LC are largely determined by product requirements, leaving only T and N as independent variables.

Optimization of crusher performance can be accomplished through the use of the following protocol by determining the feed requirements first, i.e., establishing the feed-related variables, and then selecting the crusher's operating settings:

Step 1. Determine the desired size range of the final product.

Step 2. Establish the product tonnage requirements.

Step 3. Determine the following feed characteristics: top feed size, gradation, impact work index IWI, moisture content, cleanliness, tramp possibilities, and breakage characteristics. Reduction ratio RR can be calculated from the feed size gradation and the desired product size gradation of the final product.

Step 4. Select the liner configuration based on: feed top size and reduction ratio RR. In connection with crusher 10, this step entails selection of the mantle 38 and the bowl liner 58 based on the type and gradation of feed and the product requirements.

Step 5. Select closed side setting CSS; initially based on product size; vary setting to maximize yield of finished product.

Step 6. Select initial speed N and throw T settings. These initial settings should be determined based on the liner configurations and desired product gradations, i.e., fine or coarse, and the product sizes to be maximized and minimized.

Step 7. The crusher can then be operated after initial set-up.

Step 8. If needed, based on the results of the initial crusher set-up, vary the throw T to further optimize the yield.

Step 9. Upon satisfactory adjustment of the throw T, the speed N may be adjusted to ultimately optimize the yield.

Step 10. The liner profiles should also be checked periodically to assure wear on the liner crushing surfaces is even. Variations in speed can be made to assure that the liners wear evenly and retain profiles similar to the original, unworn profiles.

Step 11. Steps 8–10 are then repeated as needed.

FIG. 9 illustrates an example of the optimization procedure. Each of lines TN1, TN2 and TN3 represent a combination of throw T and speed N settings, and are plotted in relation to axes respectively showing screen size opening and percentage passing the screen size opening.

The goal in this example is to maximize the percentage fractions between −⅜"×20 Mesh. and minimize −20 Mesh. For TN1, the net percentage of −⅜×20 Mesh. is 80% (83−3) and 3% of −20 Mesh. For TN2, the respective percentages are 84% and 8%, and, for TN3, the respective percentages are 76% and 19%. Clearly, the choice is between TN1 and TN2. A customer can choose between TN1 and TN2 based on the decision criteria they select.

This is an excellent example of how the variation of the throw T and the speed N can provide effective control over the crusher operation and afford optimization of the operation to achieve the desired results.

Various features of the invention are set forth in the following claims.

What is claimed is:

1. A cone crusher comprising:

a frame;

a crusher head supported by said frame for gyration about an axis;

a bowl supported by said frame in spaced relation to said crusher head;

a fixed shaft supported by said frame; and means supported by said support shaft for varying the eccentricity of said gyration of said crusher head, said means including a first eccentric member supported by a second eccentric member for pivotal movement relative to the second eccentric member.

2. The cone crusher as set forth in claim 1 wherein said first eccentric member engages said crusher head and is supported by said support shaft, said first eccentric member being eccentrically pivotable about a second axis angularly offset from said first-mentioned axis.

3. The cone crusher as set forth in claim 2 wherein said first eccentric member has an outer surface with a circular cross-section, and wherein said outer surface is eccentric with respect to said second axis.

4. The cone crusher as set forth in claim 2 wherein said second eccentric member is supported by said support shaft and defines said second axis, said second eccentric member being eccentrically rotatable about said first-mentioned axis.

5. The cone crusher as set forth in claim 4 wherein said first eccentric member has an outer surface with a circular cross-section, and wherein said outer surface is eccentric with respect to said second axis.

6. The cone crusher as set forth in claim 2 wherein said outer surface of said first eccentric member defines an eccentric member centerline, and wherein said first-mentioned axis, said second axis, and said eccentric member centerline extend through a fixed point.

7. The cone crusher as set forth in claim 1 wherein said second eccentric member is an inner eccentric member supported by said support shaft for gyration about said axis, and said first eccentric member is an outer eccentric member pivotably supported by said inner eccentric member for eccentric pivoting movement relative to and about said inner eccentric member, said outer eccentric member engaging said crusher head and being pivotable relative to said inner eccentric member to vary the eccentricity of said gyration of said crusher head.

8. The cone crusher as set forth in claim 7 wherein said inner eccentric member has an outer surface defining an inner eccentric member centerline, and wherein said outer eccentric member is eccentrically pivotable about said inner eccentric member centerline.

9. The cone crusher as set forth in claim 8 wherein said inner eccentric member has an outer surface and defines at least a first radius between a point on said outer surface and said axis and a second radius between another point on said outer surface and said axis, wherein said outer eccentric member has an outer surface and defines at least a first radius between a point on said outer surface and said inner eccentric member centerline and a second radius between another point on said outer surface and said inner eccentric member centerline, wherein, when said first radius of said inner eccentric member and said first radius of said outer eccentric are radially aligned, said crusher head rotates with a first eccentricity, and wherein when said first radius of said inner eccentric member and said second radius of said outer eccentric are radially aligned, said crusher head rotates with a second eccentricity.

10. The cone crusher as set forth in claim 9 wherein said outer surface of said outer eccentric member defines a plurality of radii between said outer surface and said inner eccentric member centerline, each of said plurality of radii being alignable with said first radius of said inner eccentric member so that the eccentricity of said gyration of said crusher head is infinitely adjustable between said first eccentricity and said second eccentricity.

11. The cone crusher as set forth in claim 7 wherein said inner eccentric member has an outer surface defining an inner eccentric member centerline, wherein said outer eccentric member has an outer surface defining an outer eccentric member centerline, and wherein said inner eccentric member centerline, said outer eccentric centerline and said axis extend through a fixed point.

12. A cone crusher comprising:

a frame;

a crusher head supported by said frame for gyration about a first axis;

a bowl supported by said frame in spaced relation to said crusher head;

a first eccentric member engaging said crusher head and being eccentrically pivotable about a second axis angularly offset from said first axis; and a second eccentric member supporting said first eccentric member.

13. The cone crusher as set forth in claim 12 wherein said first eccentric member has an outer surface with a circular cross-section, and wherein said outer surface is eccentric with respect to said second axis.

14. The cone crusher as set forth in claim 12 wherein said second eccentric member defines said second axis, said second eccentric member being eccentrically rotatable about said first axis.

15. The cone crusher as set forth in claim 14 wherein said second eccentric member has an outer surface with a circular cross-section, and wherein said outer surface is eccentric with respect to said second axis.

16. The cone crusher as set forth in claim 12 wherein said outer surface of said first eccentric member defines an eccentric member centerline, and wherein said first axis, said second axis, and said eccentric member centerline extend through a fixed point.

17. A cone crusher comprising:

a frame;

a crusher head supported by said frame for gyration about a first axis;

a bowl supported by said frame in spaced relation to said crusher head;

an inner eccentric member supported by said frame for gyration about said axis, said inner eccentric member having a tapered outer surface; and an outer eccentric member supported by said inner eccentric member for pivoting movement relative to and about said inner eccentric member, said outer eccentric member engaging said crusher head and being pivotable relative to said first eccentric member to vary the eccentricity of said gyration of said crusher head, said outer eccentric member having a tapered inner surface complementary to said outer surface of said inner eccentric member, engagement of said inner surface of said outer eccentric member and said outer surface of said inner eccentric member preventing relative rotation of said inner eccentric member and said outer eccentric member.

18. The cone crusher as set forth in claim 17 wherein said inner eccentric member has an outer surface defining an inner eccentric member centerline, and wherein said outer eccentric member is eccentrically pivotable about said inner eccentric member centerline.

19. The cone crusher as set forth in claim 18 wherein said inner eccentric member has an outer surface and defines at least a first radius between a point on said outer surface and said axis and a second radius between another point on said outer surface and said axis, wherein said outer eccentric member has an outer surface and defines at least a first radius between a point on said outer surface and said inner eccentric member centerline and a second radius between another point on said outer surface and said inner eccentric member centerline, wherein, when said first radius of said inner eccentric member and said first radius of said outer eccentric are radially aligned, said crusher head rotates with a first eccentricity, and wherein when said first radius of said inner eccentric member and said second radius of said outer eccentric are radially aligned, said crusher head rotates with a second eccentricity.

20. The cone crusher as set forth in claim 19 wherein said outer surface of said outer eccentric member defines a plurality of radii between said outer surface and said inner eccentric member centerline, each of said plurality of radii being alignable with said first radius of said inner eccentric member so that the eccentricity of said gyration of said crusher head is infinitely adjustable between said first eccentricity and said second eccentricity.

21. The cone crusher as set forth in claim 17 wherein said inner eccentric member has an outer surface defining an inner eccentric member centerline, wherein said outer eccentric member has an outer surface defining an outer eccentric member centerline, and wherein said inner eccentric member centerline, said outer eccentric centerline and said axis extend through a fixed point.

22. The cone crusher as set forth in claim 17 and further comprising a drive mechanism for rotatably driving said inner eccentric member.

23. The cone crusher as set forth in claim 17 and further comprising a locking assembly operable to prevent relative rotation of said inner eccentric member and said outer eccentric member.

24. The cone crusher as set forth in claim 23 wherein said locking assembly includes a first locking member connected to said inner eccentric member, and a second locking member connected to said first locking member and engageable with said outer eccentric member to prevent relative rotation of said inner eccentric member and said outer eccentric member.

25. The cone crusher as set forth in claim 17 wherein said outer surface of said inner eccentric member and said inner surface of said outer eccentric member are tapered at angle of less than 7° from vertical.

26. The cone crusher as set forth in claim 17 wherein said outer surface of said inner eccentric member and said inner surface of said outer eccentric member are tapered at an angle between 3° and 6° from vertical.

27. The cone crusher as set forth in claim 17 and further comprising an indicator for indicating the rotational position of said outer eccentric member relative to said inner eccentric member.

28. The cone crusher as set forth in claim 17 wherein said crusher head is rotatable relative to said outer eccentric member, and wherein said crusher further comprises a lubrication system for providing lubricant between said crusher head and said outer eccentric member.

29. The cone crusher as set forth in claim 28 and further comprising a shaft supported by said frame and supporting said inner eccentric member, said inner eccentric member being rotatable relative to said shaft, and wherein said lubrication system provides lubricant between said shaft and said inner eccentric member.

30. A cone crusher comprising:

a frame;

a crusher head supported relative to said frame for gyration about a crusher axis so that said crusher head is pivotable about a virtual pivot point, said gyration having an eccentricity, said crusher head having an inner surface;

a bowl supported by said frame in spaced relation to said crusher head, said bowl and said crusher head defining therebetween an annular space;

a fixed shaft supported by said frame and having an outer surface with a circular cross-section, said support shaft defining said crusher axis;

means for varying the eccentricity of said gyration of said crusher head, said means for varying the eccentricity including an inner eccentric member supported by said support shaft for gyration about said crusher axis and relative to said support shaft, said inner eccentric member having an inner surface and a tapered outer surface with a circular cross-section, said outer surface defining an inner eccentric member centerline, and an outer eccentric member supported by said inner eccentric member and eccentrically pivotable about said inner eccentric member centerline relative to said inner eccentric member, said outer eccentric member having a tapered inner surface complementary to said outer surface of said inner eccentric member, said inner surface of said outer eccentric member and said outer surface of said inner eccentric member cooperating to prevent relative rotation of said inner eccentric member and said outer eccentric member, said outer eccentric member having an outer surface with a circular cross-section, said outer surface of said outer eccentric member defining an outer eccentric member centerline, wherein said inner surface of said crusher head engages said outer surface of said outer eccentric member so that said crusher head is rotatable relative to said outer eccentric member;

a locking mechanism operable to prevent relative rotation of said inner eccentric member and said outer eccentric member, said locking mechanism including a first locking member connected to one of said inner eccentric member and said outer eccentric member and a second locking member engageable with an other of said inner eccentric member and said outer eccentric member to prevent rotation of said outer eccentric member relative to said inner eccentric member;

an indicator for indicating a rotational position of said outer eccentric member relative to said inner eccentric member, said indicator including at least a first indicator member on said inner eccentric member and at least two second indicator members on said outer eccentric member, wherein said first indicator member is aligned with one of said second indicator members to indicate a first rotational position of said outer eccentric member, and wherein said first indicator member is aligned with the other of said second indicator members to indicate a second rotational position of said outer eccentric member;

a drive mechanism operatively connected to and operable to rotatably drive said inner eccentric member about said crusher axis; and a lubrication system in fluid communication with and for providing lubricant between said outer surface of said support shaft and said inner surface of said inner eccentric member and between said outer surface of said outer eccentric member and said crusher head.

* * * * *